US005866882A

United States Patent [19]

Saur et al.

[11] Patent Number: 5,866,882

[45] **Date of Patent: *Feb. 2, 1999**

[54] THERMOSTATIC WORKING ELEMENT HAVING AN ELECTRIC RESISTANCE HEATING ELEMENT AND METHOD OF MAKING SAME

[75] Inventors: Roland Saur, Stuttgart; Peter Leu, Denkendorf; Manfred Kurz, Ditzingen, all of Germany

[73] Assignee: Behr-Thomson-Dehnstoffregler GmbH & Co., Koornwestheim, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 567,767

[22] Filed: Dec. 5, 1995

[30] Foreign Application Priority Data

Dec. 15, 1994 [DE] Germany ..... 44 44 685.3

[51] Int. Cl.[6] ..... H05B 3/68; H05B 3/06; F01B 29/10

[52] U.S. Cl. ..... 219/541; 219/523; 60/528

[58] Field of Search ..... 219/505, 530, 219/534, 536, 540, 544, 546, 552, 541, 523, 436.437; 338/23–24, 232, 226, 293, 273, 276; 60/527–528, 530–531

[56] References Cited

U.S. PATENT DOCUMENTS

| | | | |
|---|---|---|---|
| 1,727,913 | 9/1929 | Svenn et al. | 219/523 |
| 2,178,297 | 10/1939 | Larkey | 219/523 |
| 2,319,477 | 5/1943 | Rush | 219/523 |
| 2,780,703 | 2/1957 | MacIntyre | 219/523 |
| 3,134,888 | 5/1964 | Ammerman | 219/523 |
| 3,173,245 | 3/1965 | Schumaat | 60/527 |
| 3,263,411 | 8/1966 | Carlson et al. | 60/527 |
| 3,376,631 | 4/1968 | Sherwood et al. | 60/527 |
| 3,505,809 | 4/1970 | Sherwood | 60/527 |
| 3,537,678 | 11/1970 | Shmueli et al. | 60/527 |
| 3,657,519 | 4/1972 | Pease | 219/523 |
| 3,895,217 | 7/1975 | Hall et al. | 219/523 |
| 3,940,591 | 2/1976 | Ting | 219/544 |
| 3,997,760 | 12/1976 | Salinger | 219/523 |
| 4,016,722 | 4/1977 | Niederer, Sr. | 60/530 |
| 4,021,643 | 5/1977 | Hall et al. | 219/523 |
| 4,045,763 | 8/1977 | Miyamoto et al. | 338/23 |
| 4,070,859 | 1/1978 | Sobecks | 60/530 |
| 4,081,963 | 4/1978 | Stove | 60/528 |
| 4,086,467 | 4/1978 | Grant | 219/544 |
| 4,104,507 | 8/1978 | Tisone et al. | 219/513 |
| 4,104,509 | 8/1978 | Bokestal et al. | 219/544 |
| 4,108,713 | 8/1978 | Weisz | 156/499 |
| 4,147,927 | 4/1979 | Pirotte | 219/534 |
| 4,282,003 | 8/1981 | Yashin et al. | 29/619 |
| 4,385,494 | 5/1983 | Golben | 60/528 |
| 4,395,623 | 7/1983 | Shimada et al. | 219/544 |
| 4,480,174 | 10/1984 | Hummel | 219/523 |
| 4,509,328 | 4/1985 | Holzer | 60/528 |
| 4,759,189 | 7/1988 | Stropkay et al. | 60/531 |
| 4,763,102 | 8/1988 | Ritt | 338/240 |
| 5,247,158 | 9/1993 | Steinhauser et al. | 219/544 |
| 5,385,296 | 1/1995 | Kurz et al. | 236/34.5 |

*Primary Examiner*—Teresa J. Walberg
*Assistant Examiner*—Sam Paik
*Attorney, Agent, or Firm*—Evenson, McKeown, Edwards & Lenahan, PLLC

[57] ABSTRACT

A thermostatic working element has a housing in which an electric resistance heating element is arranged whose electric connecting wires are sealingly guided to the outside. The resistance heating element contains a carrier body on which a resistance layer is mounted to which the connecting wires are soldered. A base is molded to the carrier body and is sealingly arranged in the housing.

15 Claims, 1 Drawing Sheet

THERMOSTATIC WORKING ELEMENT HAVING AN ELECTRIC RESISTANCE HEATING ELEMENT AND METHOD OF MAKING SAME

BACKGROUND AND SUMMARY OF THE INVENTION

This invention relates to a thermostatic working element having a housing in which an electric resistance heating element is arranged whose electric connecting wires are sealingly guided through the bottom of the housing to the outside.

A thermostatic working element of the initially mentioned type is used particularly in connection with an electrically heatable thermostatic valve, as known, for example, from German Patent Document DE 42 33 913 Al (corresponding U.S. patent application Ser. No. 08/133,368, filed Oct. 8, 1993, now U.S. Pat. No. 5,385,296.

It is an object of the invention to provide a thermostatic working element of the initially mentioned type which has the shortest possible reaction time and is securely sealed off to the outside.

This object is achieved according to preferred embodiments of the invention in that the resistance heating element contains a carrier body to which a resistance coating is applied to which the connecting wires are soldered, and in that a base made of an insulating material is cast onto the carrier body in the area of the connecting wires, which base surrounds the connecting wires and is arranged in a sealing manner in the bottom area of the housing, and in that a sealing mass which seals off the base with respect to the housing is entered into the interior of the housing.

In the case of the thermostatic working element, the resistance heating element has a relatively large surface so that a good heat transfer takes place from the resistance heating element to an expansion medium housed in the housing. As a result, a relatively high heat input can be introduced into the expansion medium within a short time without the occurrence of very high temperatures in the resistance heating element which may lead to damage to other elements housed in the housing, particularly a bag-type, rubber-elastic membrane. By means of the base and the sealing mass, a good tightness is achieved so that also in the case of the occurring high pressures, it is reliably prevented that the expansion medium comes out of the housing. A silicone may, for example, be provided as the sealing mass. Thus, it is ensured that the good sealing is also maintained for an extended operating time.

In especially preferred embodiments of the invention, the base is provided with a projection which surrounds the connecting wires and which penetrates an opening of the bottom of the housing. As a result, the soldering points are relieved by which the connecting wires are soldered to the resistance layer.

In especially preferred embodiments of the invention, the base is provided with a collar inserted into the housing with a press fit. As a result, a further supplementary sealing is achieved while, in addition, the resistance heating element is securely fixed in the housing.

In especially preferred embodiments of the invention, it is provided that the carrier body has the shape of a plate which is centrically aligned with respect to the base.

Other objects, advantages and novel features of the present invention will become apparent from the following detailed description of the invention when considered in conjunction with the accompanying drawings.

DETAILED DESCRIPTION OF THE DRAWINGS

Figure 1:
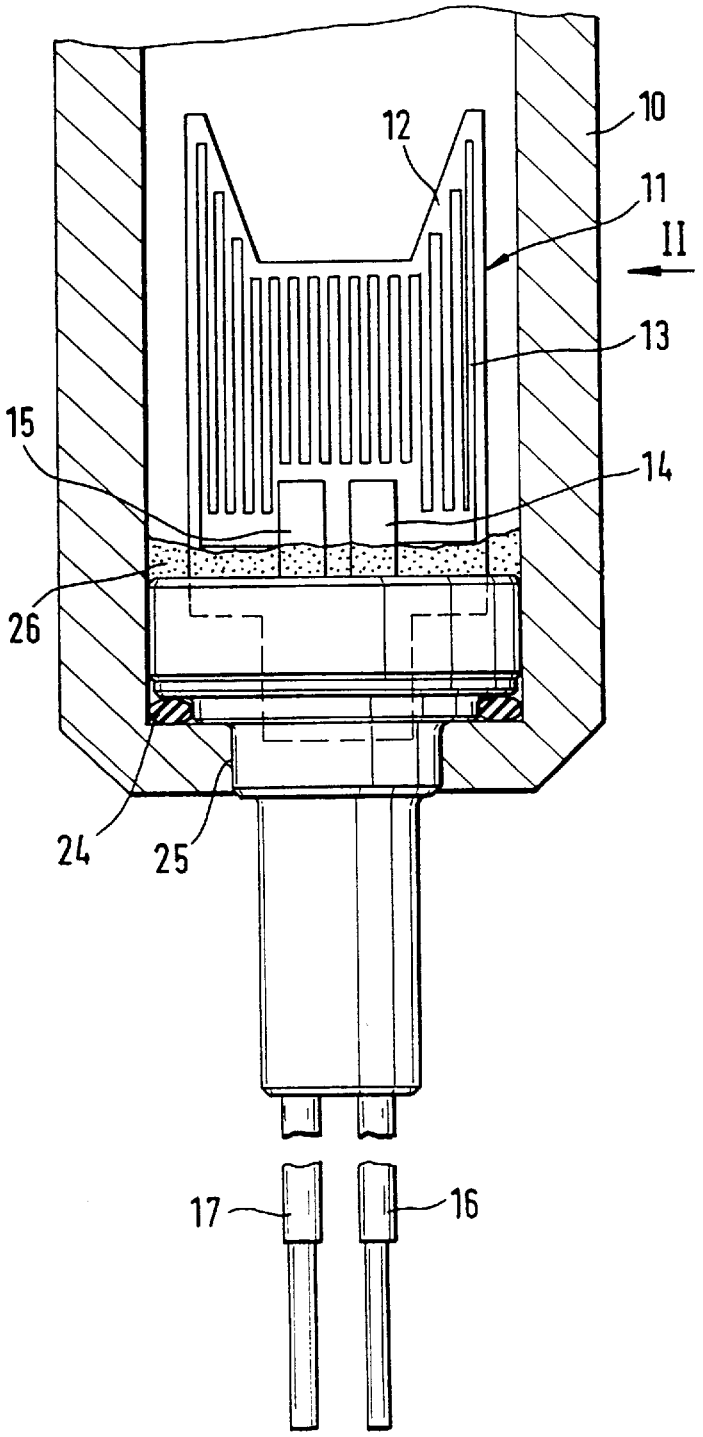
FIG. 1 is a partial sectional view of a thermostatic working element constructed according to a preferred embodiment of the invention.
Figure 2:
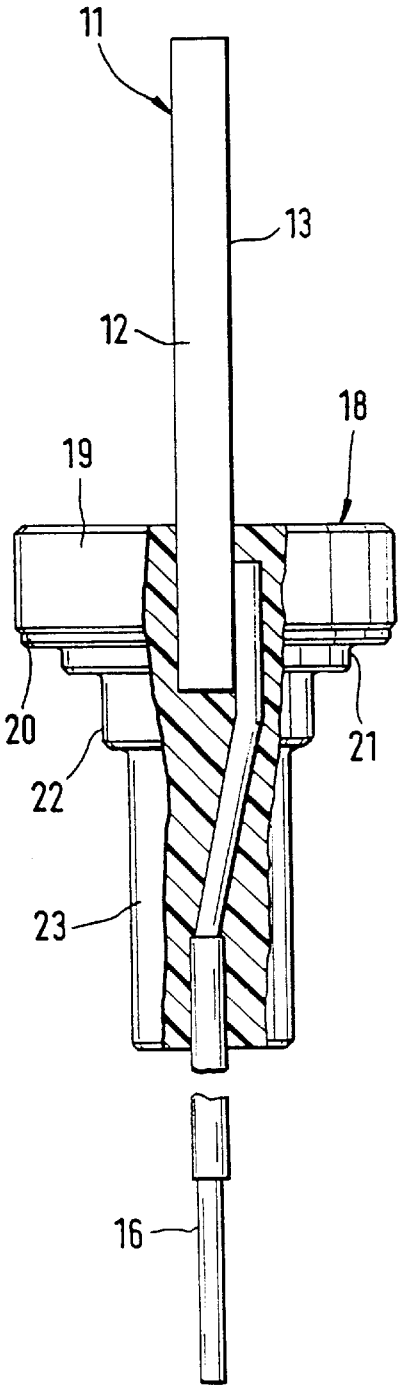
FIG. 2 is a view in the direction of the arrow II of the resistance heating element of the thermostatic working element of FIG. 1.

In the area of the open side, which is not shown, the metallic housing 10, which is illustrated only partially in FIG. 1, is provided with a guiding insert for a working piston. By means of the guiding insert, a bag-type membrane is sealingly held which projects into the housing 10 and into which a working piston is fitted. This construction is known, for example, from the above-mentioned U.S. Pat. No. 5,385,296. The interior of the housing 10 is filled with an expansion medium, particularly a wax mixture. This expansion medium changes its volume as a function of the temperature, in which case, when the temperature is raised, the working piston is driven out and is used as an adjusting element particularly for a thermostatic valve.

In the interior of the housing, an electric resistance heating element 11 is arranged which is surrounded by the expansion medium situated in the housing 10. The resistance heating element 11 has a plate-shaped carrier body 12 which, on one side, is provided with a meandering resistance layer 13. The carrier body 12 consists, for example, of an anodized and thus insulated aluminum. The resistance layer 13 is fastened on the carrier body 12, for example, by means of a heat-resistant bonding agent. In addition, the carrier body 12 is provided with two connecting contacts 14, 15 which are connected in an electrically conducting manner with the meandering resistance layer 13 and to which one connecting wire 16, 17 respectively is soldered.

A base 18 is injection-molded to the carrier body 12 and covers the area of the soldering joints by means of which the connecting wires 16, 17 are connected to the contacts 14, 15. The base 18 is made of an insulating plastic material. It has a collar 19 which corresponds to the inside diameter of the cylindrical housing 10. On the side facing the bottom of the housing 10, the collar 19 is provided with a fastening aid 20 by means of which the base 18 can be centered when being mounted on the housing 10, whereupon the collar 19 is pressed into the housing 10. On the side facing the bottom of the housing 10, the collar 19 is provided with a seat 21 which receives a sealing ring, particularly an O-ring 24. During the inserting of the base 18 into the housing 10, this O-ring 24 will be placed against the cylindrical interior wall of the housing 10 and onto its bottom while being elastically deformed. Behind this sealing seat 21, the base 18 has a collar 22 with a reduced diameter which is adapted to a recess 25 in the bottom of the housing 10. This collar 22 is adjoined by an essentially cylindrical projection 23 which surrounds the connecting wires 16, 17 and their outer insulation along a longitudinal section.

After the inserting of the base 18 into the housing 10, a sealing mass 26 is poured into the area of a base 18. Silicone may, for example, be used as the sealing mass 26. This sealing mass 26, which may also be mixed from several constituents, preferably also has permanently elastic characteristics and is bondingly held on the housing 10 and the base 18. This sealing mass 26 in its installed condition is disposed below the resistance layer 13.

The plate-shaped basic body 12, which is provided on one side with the resistance layer 13, projects relatively far into the housing 10. Its end facing away from the bottom has a V-shaped recess because, in this area, the end of the bag-shaped membrane comes to rest which membrane is not shown. The carrier body 12 may, for example, also be made of ceramics. In this case, the meandering electric resistance layer may be applied by vaporization. The resistance layer 13 results in a relatively large surface which is surrounded by the expansion medium. As a result, a correspondingly good heat transfer is obtained with a high heat transmission capacity. Thus, a relatively high heating output can be implemented while the temperature of the resistance layer itself does not reach excessive values; that is, a temperature which may lead to a damaging of other parts, for example, of the rubber elastic bag-type membrane.

In the case of a modified embodiment, it is provided that the plate-shaped carrier body 12 is provided on both sides with a resistance layer 13 which is switched to parallel heat resistances. In the case of another embodiment, two or more elements are provided as carrier bodies 12 which, on one side or on both sides, are provided with a resistance layer 13.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Thermostatic working element comprising:

a housing containing an expansion medium which expands and contracts as a function of temperature to thereby control movement of a control member of the thermostatic working element, and an electric resistance heating element arranged in said housing surrounded by said expansion medium, electric connecting wires of said electric resistance heating element being sealingly guided through a bottom of the housing to the outside, wherein the resistance heating element contains a carrier body to which a resistance heating layer is applied to which the connecting wires are soldered, wherein a base made of an insulating material is molded to the carrier body in the area of the connecting wires, which base surrounds the connecting wires and is sealingly arranged in the bottom area of the housing, and wherein a sealing mass is inserted in an interior of the housing which bonds to said housing and said base and seals off the base with respect to the housing.

2. Working element according to claim 1, wherein the sealing mass also covers an area of the base where the carrier body projects out of the base.

3. Working element according to claim 1, wherein the base is provided with a projection which surrounds the connecting wires and which penetrates an opening of the bottom of the housing.

4. Working element according to claim 1, wherein the base is provided with a collar inserted into the housing with a press fit.

5. Working element according to claim 1, wherein the base is provided with a seat for receiving a sealing ring on a side facing the bottom of the housing.

6. Working element according to claims 1, wherein the carrier body has the shape of a plate arranged centrically with respect to the base.

7. Working element according to claim 1, wherein the carrier body includes a plurality of heating elements which are held by means of the base.

8. Working element according to claim 1, wherein the resistance layer is arranged in a meandering manner on at least one said of the carrier body.

9. Working element according to claim 2, wherein the base is provided with a projection which surrounds the connecting wires and which penetrates an opening of the bottom of the housing.

10. Working element according to claim 9, wherein the base is provided with a collar inserted into the housing with a press fit.

11. Working element according to claim 10, wherein the base is provided with a seat for receiving a sealing ring on a side facing the bottom of the housing.

12. Working element according to claim 11, wherein the carrier body has the shape of a plate arranged centrically with respect to the base.

13. Working element according to claim 12, wherein the carrier body includes a plurality of heating elements which are held by means of the base.

14. Working element according to claim 13, wherein the resistance layer is arranged in a meandering manner on at least one side of the carrier body.

15. Thermostatic working element according to claim 1, wherein said sealing mass has permanently elastic characteristics and is bondingly held on the base and the housing, and wherein said sealing mass is disposed below the resistance heating element when in an installed condition.

* * * * *